US008942399B2

(12) United States Patent
Salameh

(10) Patent No.: US 8,942,399 B2
(45) Date of Patent: Jan. 27, 2015

(54) METHODS FOR WIDEBAND RECEIVER AND MODULE FOR A HEARING ASSISTANCE DEVICE

(71) Applicant: Starkey Laboratories, Inc., Eden Prairie, MN (US)

(72) Inventor: Mohamad A. Salameh, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/024,342

(22) Filed: Sep. 11, 2013

(65) Prior Publication Data

US 2014/0140553 A1 May 22, 2014

Related U.S. Application Data

(60) Provisional application No. 61/728,195, filed on Nov. 19, 2012.

(51) Int. Cl.
*H04R 25/00* (2006.01)
*H04R 1/22* (2006.01)
*H04R 1/26* (2006.01)

(52) U.S. Cl.
CPC ..... *H04R 25/60* (2013.01); *H04R 25/48* (2013.01); *H04R 1/227* (2013.01); *H04R 1/26* (2013.01); *H04R 25/456* (2013.01)
USPC ..... 381/322; 381/324; 381/328

(58) Field of Classification Search
USPC ..... 381/312, 320, 324, 328, 330, 345, 380, 381/381, 382, 182, 186, 418
See application file for complete search history.

(56) References Cited

U.S. PATENT DOCUMENTS

| | | | | |
|---|---|---|---|---|
| 8,135,163 | B2 * | 3/2012 | Blanchard et al. | 381/418 |
| 2007/0291971 | A1 * | 12/2007 | Halteren | 381/322 |
| 2010/0128905 | A1 * | 5/2010 | Warren et al. | 381/312 |

FOREIGN PATENT DOCUMENTS

EP 1684544 A2 7/2006

* cited by examiner

*Primary Examiner* — Huyen D Le
(74) *Attorney, Agent, or Firm* — Schwegman Lundberg & Woessner, P.A.

(57) ABSTRACT

Disclosed herein, among other things, are systems and methods for wideband receiver modules for hearing assistance devices. One aspect of the present subject matter includes an apparatus for use with a hearing assistance device. The apparatus includes two low frequency spout-less receivers configured to act as a woofer, and a dual receiver attached to the front of the woofer, the receiver configured to act as a tweeter. According to various embodiments, the acoustical load for each of the two low frequency receivers form a channel on each side of the tweeter. The apparatus is adapted to extend bandwidth of the hearing assistance device and to maintain low vibration of the dual receiver, in various embodiments. Various embodiments include sharing back volumes for receivers and improved perforated wax protections guides to further improve device performance.

26 Claims, 13 Drawing Sheets

METHODS FOR WIDEBAND RECEIVER AND MODULE FOR A HEARING ASSISTANCE DEVICE

PRIORITY APPLICATION

The present application claims the benefit of priority under 35 U.S.C. §119(e) to U.S. Provisional Application No. 61/728,195 filed on Nov. 19, 2012, which is incorporated herein by reference in its entirety.

TECHNICAL FIELD

This document relates generally to hearing assistance systems and more particularly to methods for wideband receiver and module for hearing assistance devices.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry. Transducers include receivers, or speakers, that are configured to play sound to a wearer's ear.

Receivers that are currently available for wideband sound processing use dual receiver design. One side of the receiver is tuned for low frequency output and works as a woofer. The other side is tuned for high frequency output and works as a tweeter. Both woofer and tweeter share the same spout. This wideband (WB) dual receiver design does not have smooth frequency responses needed to extend the frequency bandwidth on low and high frequencies. Also, it does not have the vibration cancellation observed in identical dual receivers. Therefore, the vibration of this wideband receiver is high and comparable with the vibration of a single receiver. High vibration may cause hearing aid feedback for some frequencies including the extended bandwidth frequencies and therefore limits the available maximum gain in the hearing aid.

Accordingly, there is a need in the art for improved systems and methods for wideband receiver modules for hearing assistance devices.

SUMMARY

Disclosed herein, among other things, are systems and methods for wideband receiver modules for hearing assistance devices. One aspect of the present subject matter includes an apparatus for use with a hearing assistance device. The apparatus includes two low frequency spout-less receivers configured to act as a woofer, and a dual receiver attached to the front of the woofer, the receiver configured to act as a tweeter. According to various embodiments, the acoustical load for each of the two low frequency receivers form a channel on each side of the tweeter. The apparatus is adapted to extend bandwidth of the hearing assistance device and to maintain low vibration of the dual receiver, in various embodiments.

One aspect of the present subject matter includes a receiver assembly including a housing and two low frequency spout-less receivers within the housing, the two low frequency receivers configured to act as a woofer. The assembly further includes a dual receiver within the housing and attached to the front of the woofer, the receiver configured to act as a tweeter. A perforated angled tube is connected to an outlet for the tweeter, and the tube configured for wax protection and improved high frequency output. According to various embodiments, the acoustical load for each of the two low frequency receivers form a channel on each side of the tweeter. The receiver assembly is adapted to maintain low vibration of the dual receiver, in various embodiments.

One aspect of the present subject matter includes a method of making a receiver assembly for a hearing assistance device. Two low frequency spout-less receivers are configured to act as a woofer, and a dual receiver is attached to the front of the woofer, the receiver configured to act as a tweeter. A channel is formed on each side of the tweeter using the acoustical load for each of the two low frequency receivers. According to various embodiments, the method extends the bandwidth of the hearing assistance device and provides a smooth frequency response with low vibration.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Figure 4:
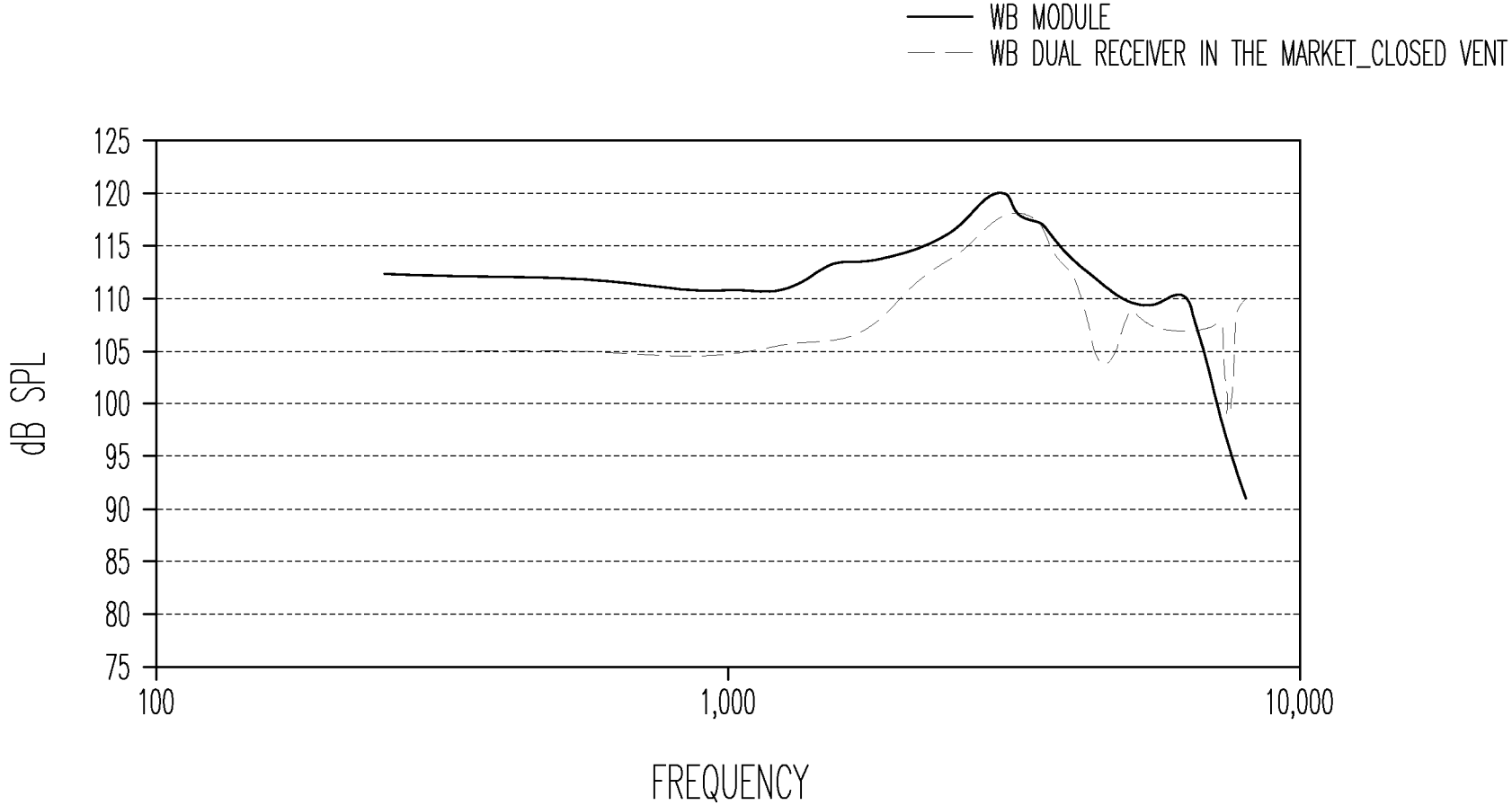
FIGS. 4-10 illustrate graphical diagrams showing measurement results over a range of frequencies for a receiver assembly, according to various embodiments.

Receivers that are currently available for wideband sound processing use dual receiver design. One side of the receiver is tuned for low frequency (LF) output. The other side is tuned for high frequency (HF) output. Both sides of the receiver share the same spout. The output and the bandwidth of the receiver are limited as reflected in their non-uniform frequency response and relatively high distortion, as shown in FIG. 4 for example. Also, the vibration of this wideband receiver is high and comparable with the vibration of a single receiver. In addition, the wax protection system used currently in the hearing aid serves as a wax protection device only and causes a few decibels (dBs) of undesired output attenuations.

Disclosed herein, among other things, are systems and methods for wideband receiver modules for hearing assistance devices. One aspect of the present subject matter includes an apparatus for use with a hearing assistance device. The apparatus includes two low frequency spout-less receivers configured to act as a woofer, and a dual receiver attached to the front of the woofer, the receiver configured to act as a tweeter. According to various embodiments, the acoustical load for each of the two low frequency receivers form a channel on each side of the tweeter. The apparatus is adapted to extend bandwidth of the hearing assistance device and with low vibration, in various embodiments.

The present subject matter improves the wideband frequency response of the receiver assembly and introduces a compact wideband receiver module. In various embodiments, two identical low frequency receivers are placed in the module so that their low frequency sounds are combined in front of the HF receiver or in the module nozzle. The acoustical load for each receiver forms a cavity on each side of the HF receiver. These receivers are spout-less and their back volumes are linked, in an embodiment. Also, they can be placed in the module without their front cavities. The HF receiver (dual or single) is placed in front of the LF receiver in a straight or curved line. The HF receiver outlet is aligned behind the assembly module nozzle.

Acoustically linking the receivers back volumes (or sharing their back volumes) along with relatively large acoustical load noticeably improve the output on low frequencies. This vented receiver package is small, robust and resolves the issues of leaks from the extra cavity needed for the receiver vents. In addition, the wax-foreign material protection system is used efficiently for better output in addition to their main function. Sound attenuation of this system is low mainly due to the large surface area of the openings that the sound passes through as well as the cone shape that provide better HF sound radiation.

The module of the present subject matter incorporates all of the above concepts and provides better low and high frequency outputs with efficient use of the space layout and the wax-foreign material prevention devices. The present subject matter provides the low and high frequency output with efficient use of the space layout and wax prevention system and low vibration. The present subject matter resolves the vibration issue with the conventional dual receiver (woofer-tweeter) design currently available for wideband sound processing and it improves the output with a smooth frequency response. In various embodiments, it can be used to adjust the frequency response for specific requirements by selecting appropriate receivers and electrical filters, and by adjusting the mechanical layout of the module, among other applications.

The present subject matter uses methods to improve the wideband smooth acoustical output of receiver systems along with methods for compact wideband receiver module. The solution can be used for hearing aid devices or for any other small hearing devices such as in-ear-monitors or earphones. Each of the following methods can be used separately or together to achieve the wideband output improvement in a small robust package.

According to various embodiments, each receiver of two combined receivers is back vented into the back volume of the other receiver and the receiver outlets and front volumes are placed on the outer common perimeter. The size and shape of the vent varies and can extend to the full surface between the receivers, in various embodiments. In various embodiments, the back volumes of the receivers are acoustically linked for better acoustical performance is a small dual receiver package. The receivers can be low frequency (LF), high frequency (HF) or full range receivers, in various embodiments. The module in FIG. 1 uses LF receivers.

Figure 1:
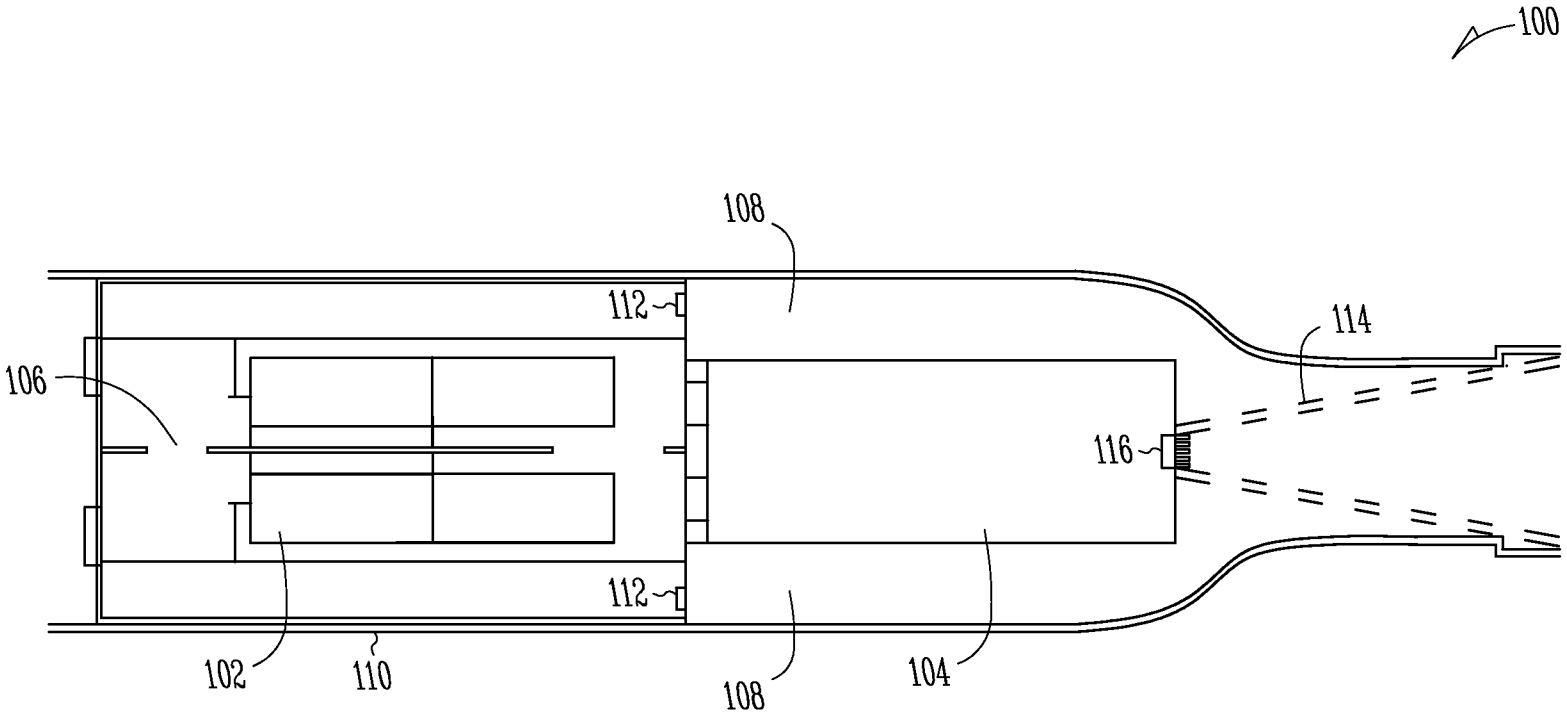
FIG. 1 illustrates a diagram of a receiver assembly for use with a hearing assistance device, according to one embodiment.

The wax protection device or the foreign material protection device is used for better acoustical output in addition to their protection function, according to various embodiments. The improvement is achieved by using relatively large surface area of the openings in the protection device and by optimizing the orientation and/or shape of the device surface. Both of these factors are designed so that sound passes through relatively large openings or perforations in the surface of the protection device, therefore the acoustical attenuation is reduced. The wax protection device in FIG. 1 is used for better LF and HF outputs. The total surface area of the perforation openings (holes) in the LF sound path is large and the shape of the wax protection device is a cone or horn-like which efficiently directs the sound toward the module output, in various embodiments. The opening area that is virtually seen by the HF receiver outlet is small therefore the cone function for better high frequency acoustical radiation is mostly maintained. In various embodiments, the perforation uses the cone function (providing better acoustical radiation especially high frequency) and at the same time allows additional sound wave (LF) to pass through in a minimum package size. Sound passes through relatively large perforated or open area in the cone therefore the acoustical attenuation is minimized. This large open cone area in the overall sound path is the result of the relative layout of the sound paths and the cone itself. The overall acoustical path or load is divided into two or more paths, in various embodiments. In various embodiments, the sound encounters the cone with perpendicular angles over a large open surface area. The perforation can be any opening, mesh or grid that maintains the function of the angled surface of the cone, in various embodiments.

In an embodiment, one receiver is attached to the front of the other receivers to form wideband small receiver module. The outlet of the front receiver is positioned as close as possible to the module nozzle, in this embodiment. Also, the front receiver(s) can be partially or fully placed inside the module nozzle itself spatially if a single receiver is used. The module shown in FIG. 1 includes 3 receivers, two positioned in the back of the module for LF sound and one dual receiver in the front for HF sound.

FIG. 1 illustrates a diagram of a receiver assembly (or module) 100 for use with a hearing assistance device, according to one embodiment. The depicted embodiment uses three small single receivers. Two receivers 102 that form the LF woofer are placed in the module housing 110 so that their low frequency sounds are combined in front of the tweeter or in the module main outlet. The housing 110 includes a number of outlets 112 that are on the outside of the combined LF receivers to allow receiver venting and acoustical load division. In various embodiments, the LF receivers 102 share their back volumes 106 for better LF performance and a robust small package. The woofer 102 is located back in the module so that the acoustical load causes frequency shift of the main peak therefore achieving better low frequency response which extends the bandwidth at the low end of the spectrum, in an embodiment. The spouts 116 are removed from these receivers, for higher efficiency and smaller size (improved packaging). In FIG. 1, the tweeter, or HF receiver 104, is attached directly to the front of the woofer and is positioned close to the module nozzle for better HF delivery. The tweeter 104 can be spouted or spout-less. In various embodiments, the tweeter 104 is a single receiver. Cavities 108 are configured for a large acoustical load for better LF response, in various embodiments. The woofer-tweeter layout can be arranged in straight line or in curve to fit a specific requirement for the space layout. The layout of a perforated angled guide or tube 114 for wax protection/prevention utilizes the space efficiently and improves the sound delivery especially on high frequency. Sound attenuation of this system is low due to the large total surface area of the openings.

Figure 2A:
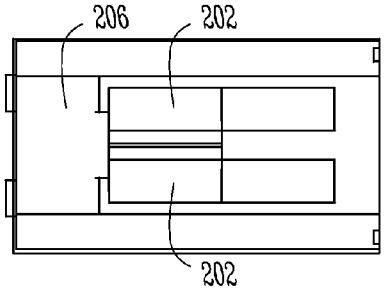
FIGS. 2A-2H illustrate diagrams of receiver assemblies for use with a hearing assistance device, according to various embodiments.
Figure 2B:
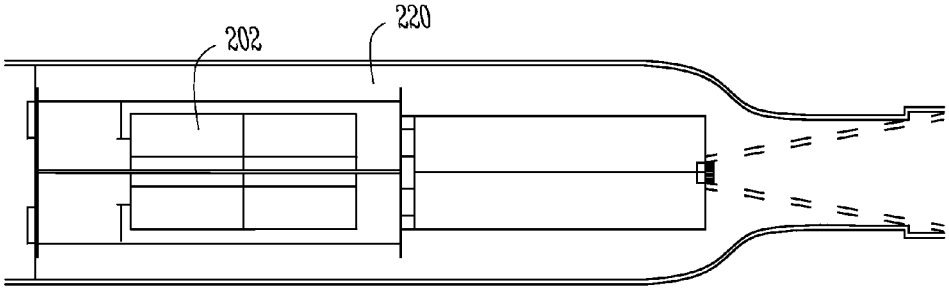
Figure 2C:
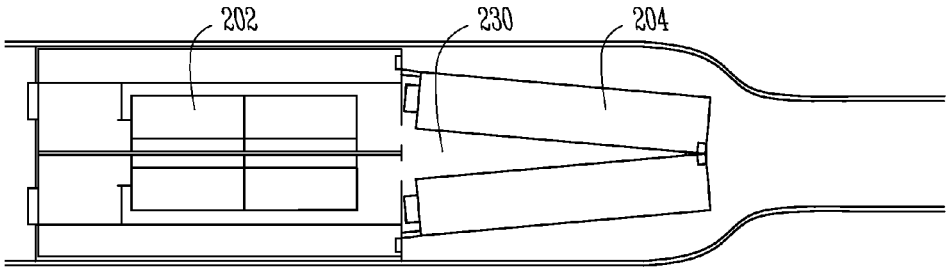
Figure 2D:
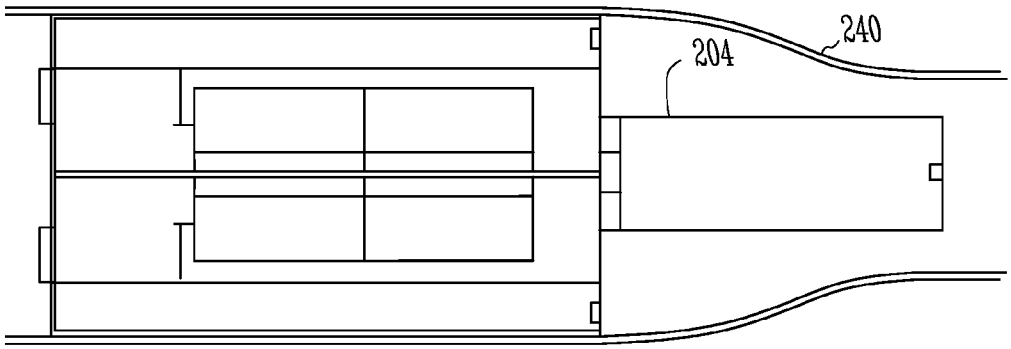
Figure 2E:
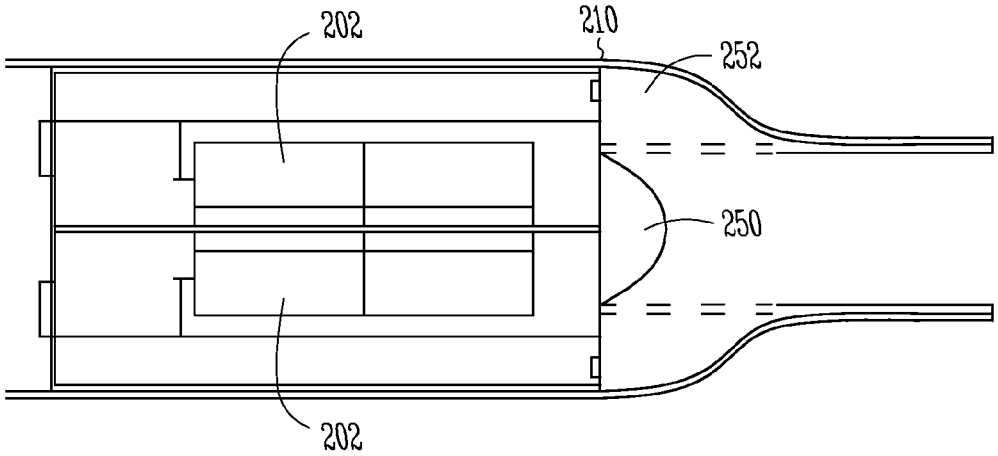
Figure 2F:
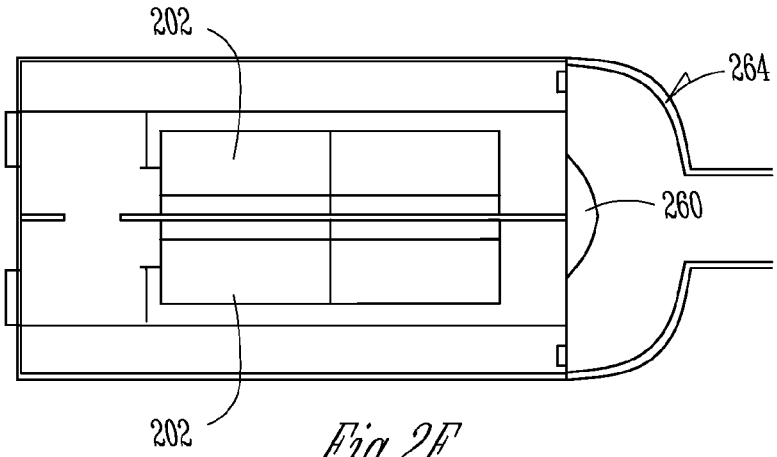
Figure 2G:
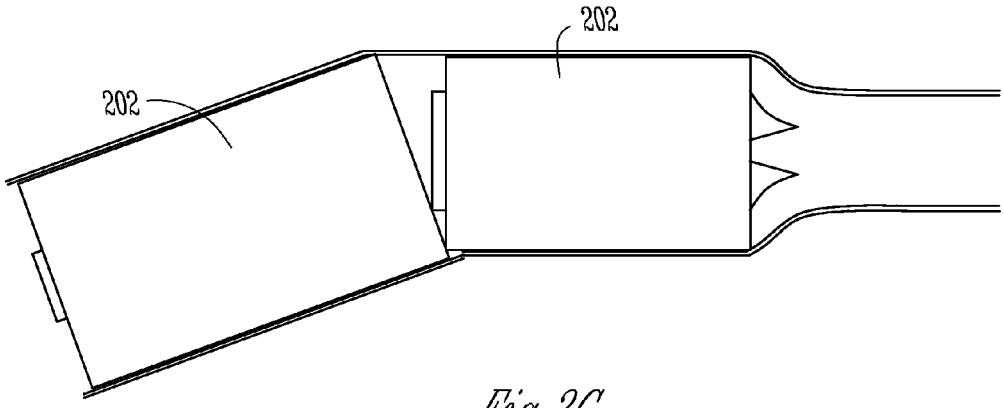
Figure 2H:
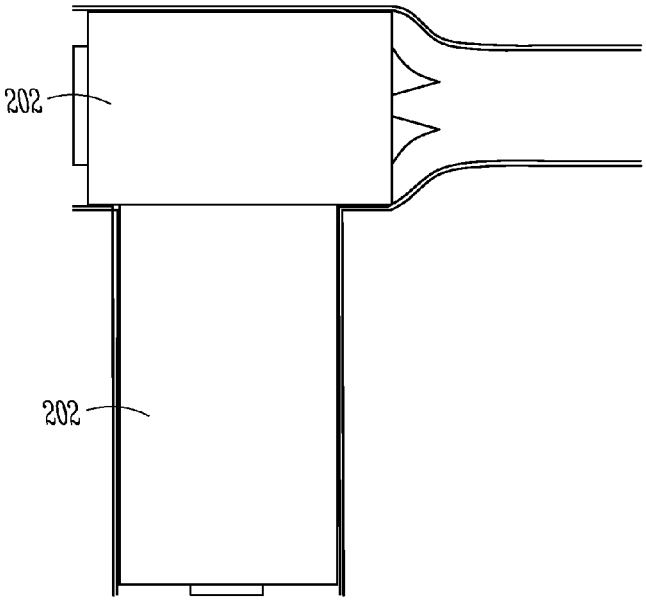

FIGS. 2A-2H illustrate diagrams of receiver assemblies for use with a hearing assistance device, according to various embodiments. FIG. 2A illustrates an embodiment in which each of the low frequency receivers 202 (woofer) share one back volume 206. Each receiver motor and back volume is completely open to the other receiver back volume and motor. FIG. 2B illustrates an embodiment in which the front volume 220 of the LF receiver 202 is formed via the housing and is not part of the standard receiver assembly. FIG. 2C illustrates an embodiment in which both sides of the LF receiver/woofer 202 are vented in a space 230 formed from the layout of the other receivers, in this case the HF dual receiver/tweeter 204. FIG. 2D illustrates an embodiment in which the tweeter 204 is a small single receiver and the module nozzle 240 is around the tweeter 204. FIG. 2E illustrates an embodiment in which the receiver assembly includes two combined receivers 202 (vented or not vented), and an object 250 is added to the front of the receivers. The object 250 and the module housing 210 form a smooth acoustical path 252 to improve output from the assembly. The object 250 can be part of the wax protection device and/or the foreign material protection device, in various embodiments. FIG. 2F illustrates an embodiment in which a relatively large spout 264 and front object 260 are added to the combined receivers 202, without a module, for a smooth acoustical path and improved output. FIGS. 2G-2H illustrates embodiments in which the layout of the receivers 202 forms a curved path to accommodate a specific layout requirement of the hearing assistance device.

Figure 3A:
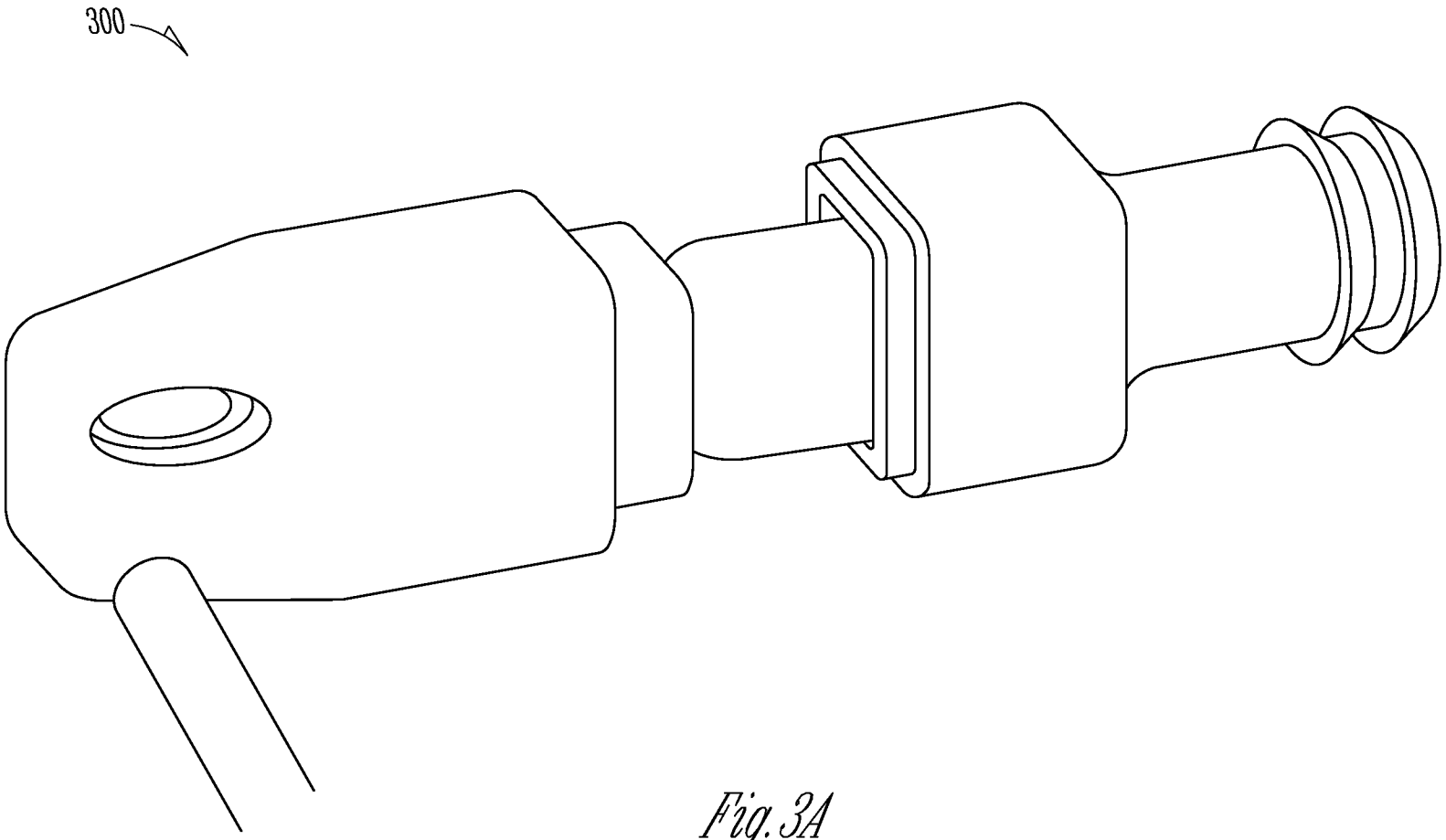
FIGS. 3A-3D illustrate embodiments of a receiver assembly housing for use with a hearing assistance device.
Figure 3B:
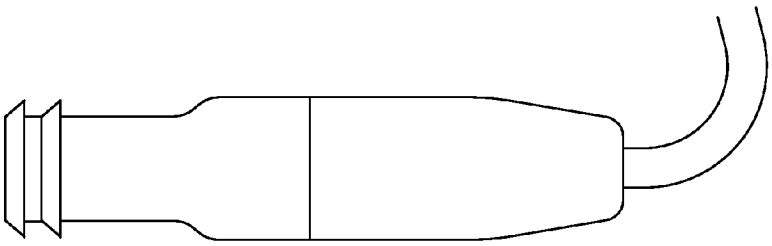
Figure 3C:
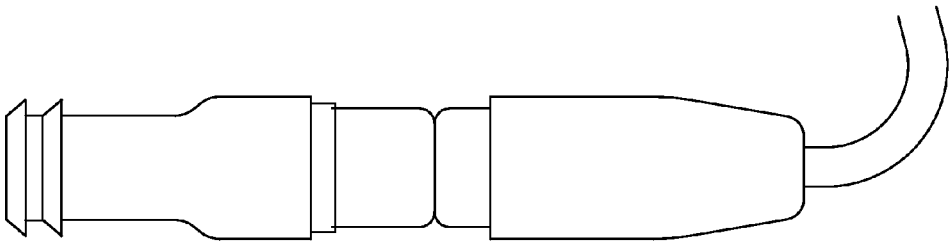
Figure 3D:
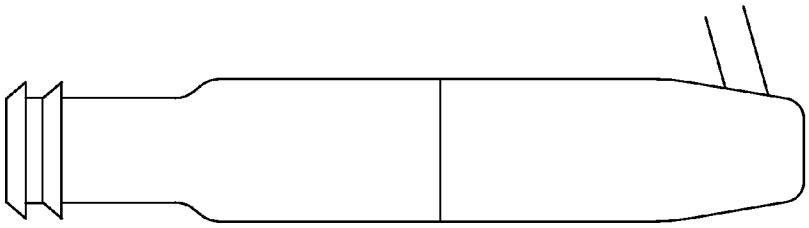

FIGS. 3A-3D illustrate embodiments of a receiver assembly housing for use with a hearing assistance device. These depicted embodiments include housings used in a receiver-in-canal (RIC) hearing aid, but the housings can be adapted for other hearing assistance devices without departing from the scope of the present subject matter. FIG. 3A shows a side view of a receiver assembly housing 300 of the present subject matter, according to various embodiments. In this figure a part of the housing material is removed to expose the receivers inside. The solder pads of the tweeter are moved form the back of the tweeter to the tweeter top and inside the woofer acoustical path to reduce the length of the module. FIGS. 3B-3D illustrate an embodiment of the receiver assembly of the present subject matter in which the cable attached to the assembly housing has been moved or modified to limit the length of the assembly so it will take up equal or less space compared to the housing shown in FIG. 3B.

FIGS. 4-10 illustrate graphical diagrams showing measurement results over a range of frequencies for a receiver assembly, according to various embodiments. FIG. 4 shows a comparison of the maximum possible output (MPO) measurement results for the wideband module and a typical wideband (WB) dual receiver found in the market and noted above. The measurement applies a limitation on maximum voltage drive and maximum distortion that either assembly can provide. The acoustical loads for both assemblies are made the same. The graph shows that the output of the module is noticeably higher and smoother compared with a typical WB dual receiver. Also, since this MPO measurement considers the distortion limit, the graph illustrates the low distortion of the wideband module.

Figure 5:
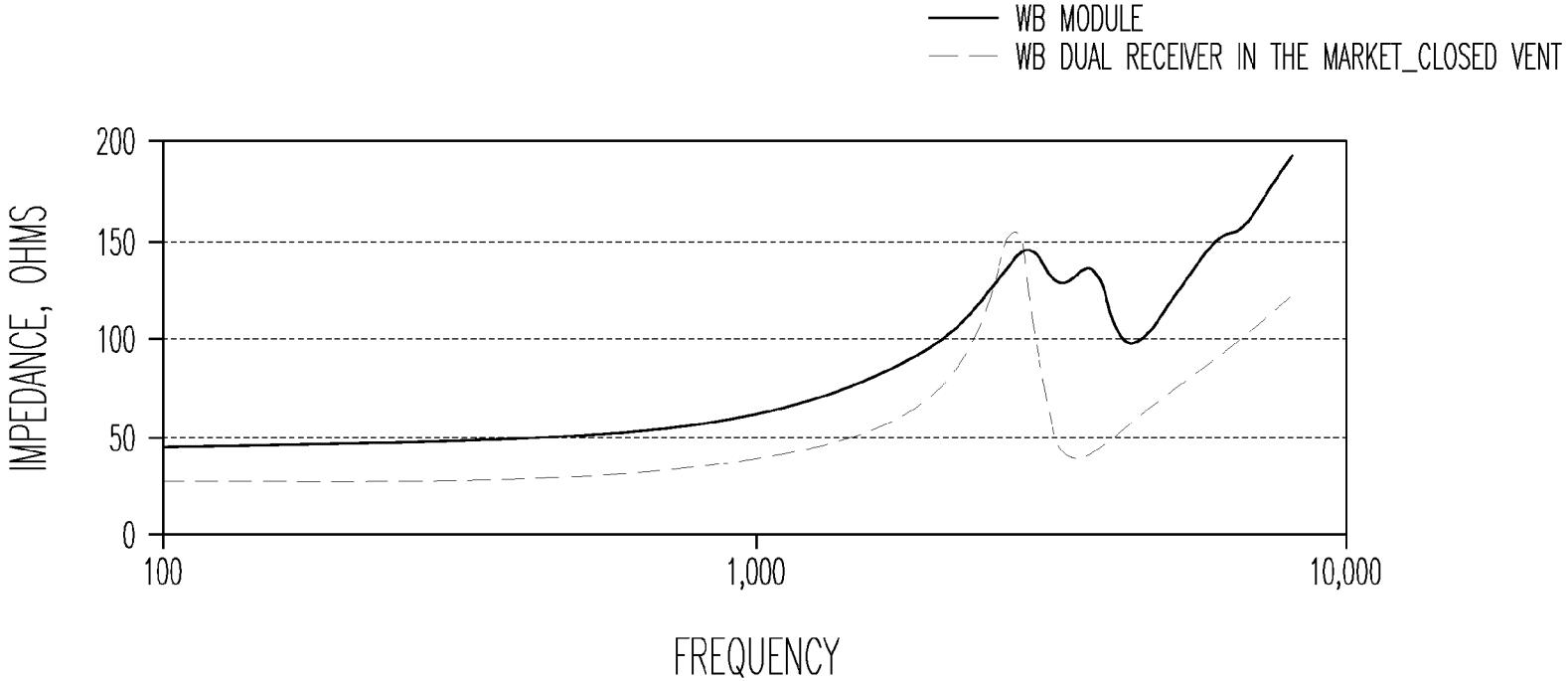

FIG. 5 shows the impedance measurement results for two receiver assemblies shown in FIG. 4. The impedance of the wideband module is generally higher than the WB dual receiver and this reduces the current drain in the hearing aid.

Figure 6:
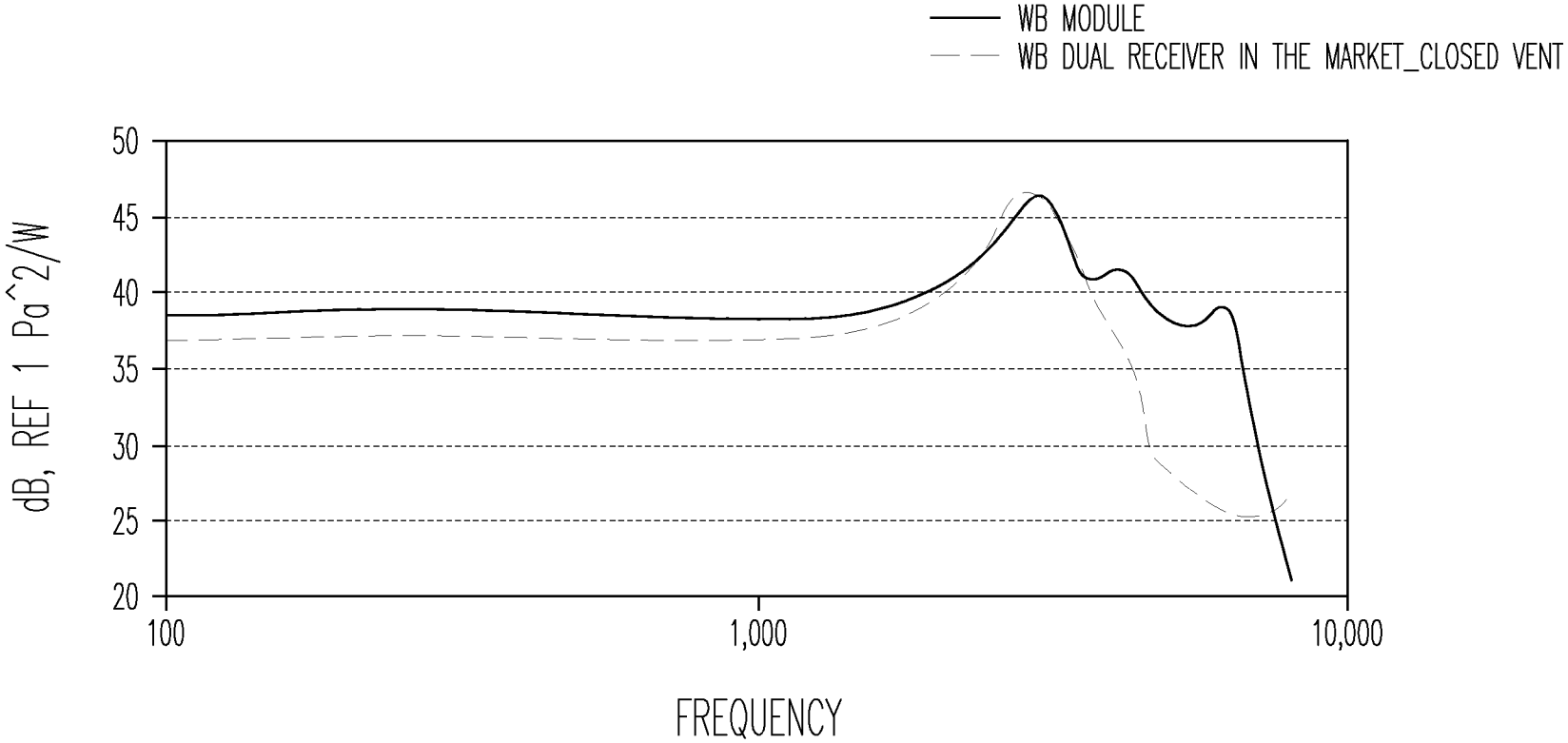

FIG. 6 shows the power efficiency level measurement results for two receiver assemblies shown in FIG. 4. It reflects the efficiency advantage of the wideband module over the WB dual receiver especially on high and low frequencies without considering the distortion. The advantage even bigger if the distortion is considered according to FIG. 4.

Figure 7:
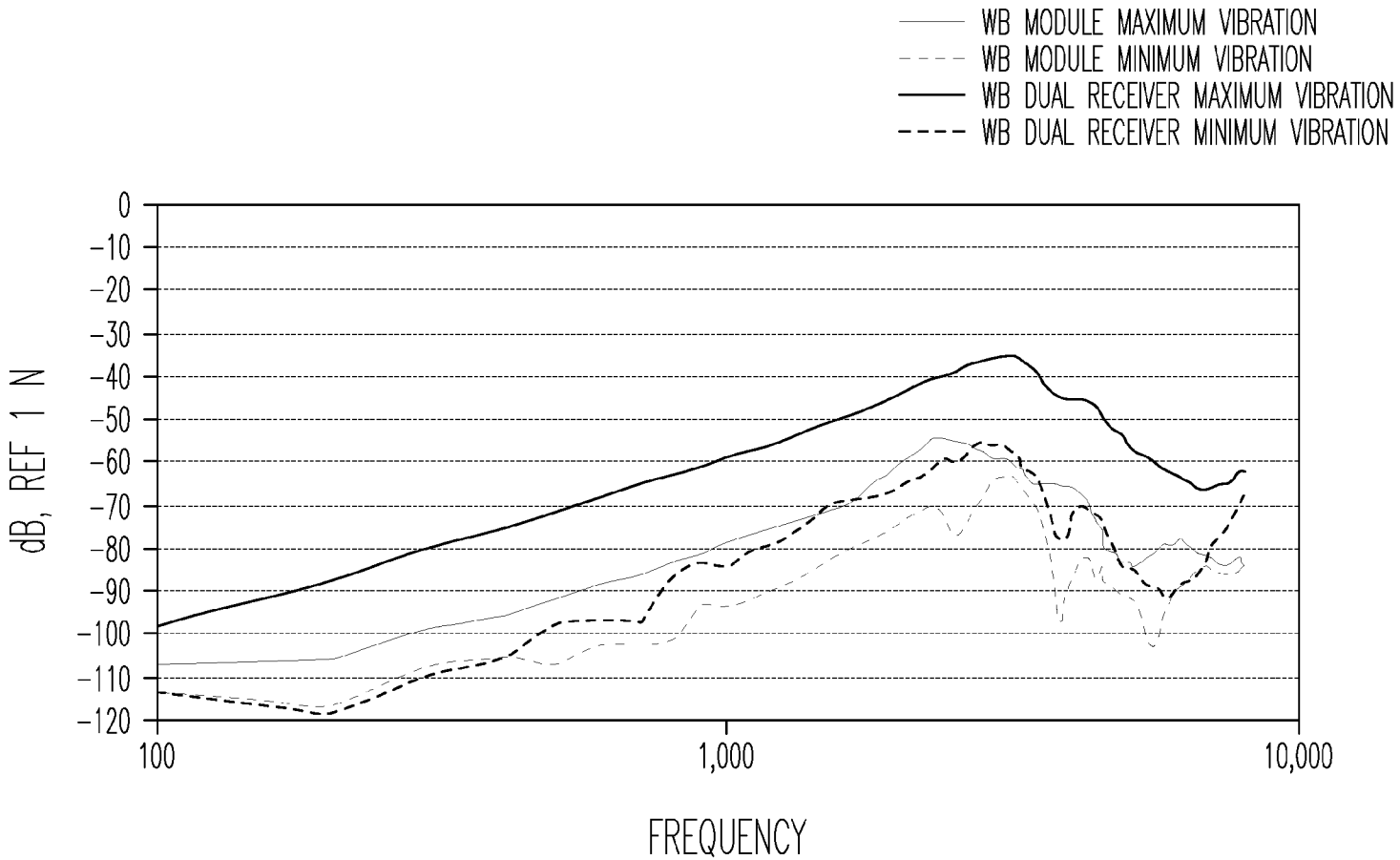
Figure 8B:
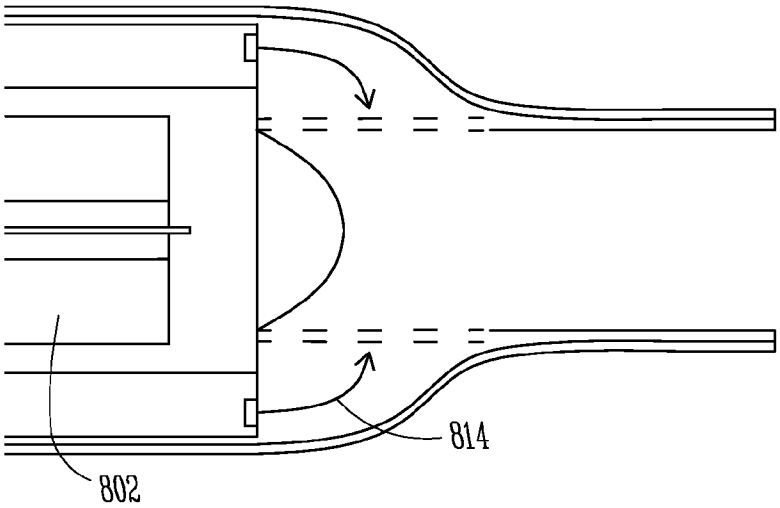
Figure 8A:
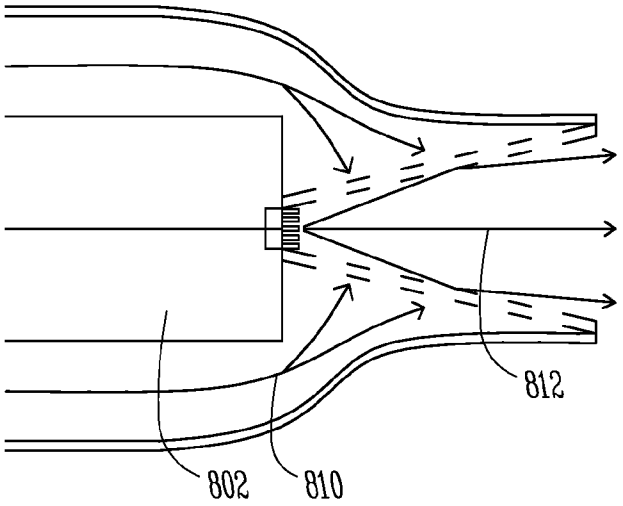

FIG. 7 shows the vibration measurement results for two receiver assemblies shown in FIG. 4. The receiver vibration depends on the location of the test point at the receiver hence the maximum and minimum values are shown. The measurement results clearly show the vibration advantage of the module over the WB dual receiver FIGS. 8A and 8B shows the acoustical paths of the receiver 802 in relation to a perforated wax-foreign material device according to various claims and embodiments. In FIG. 8A, the LF sound path 810 and HF sound path 812 are shown, and in FIG. 8B a combined sound path 814 is depicted.

Figure 9:
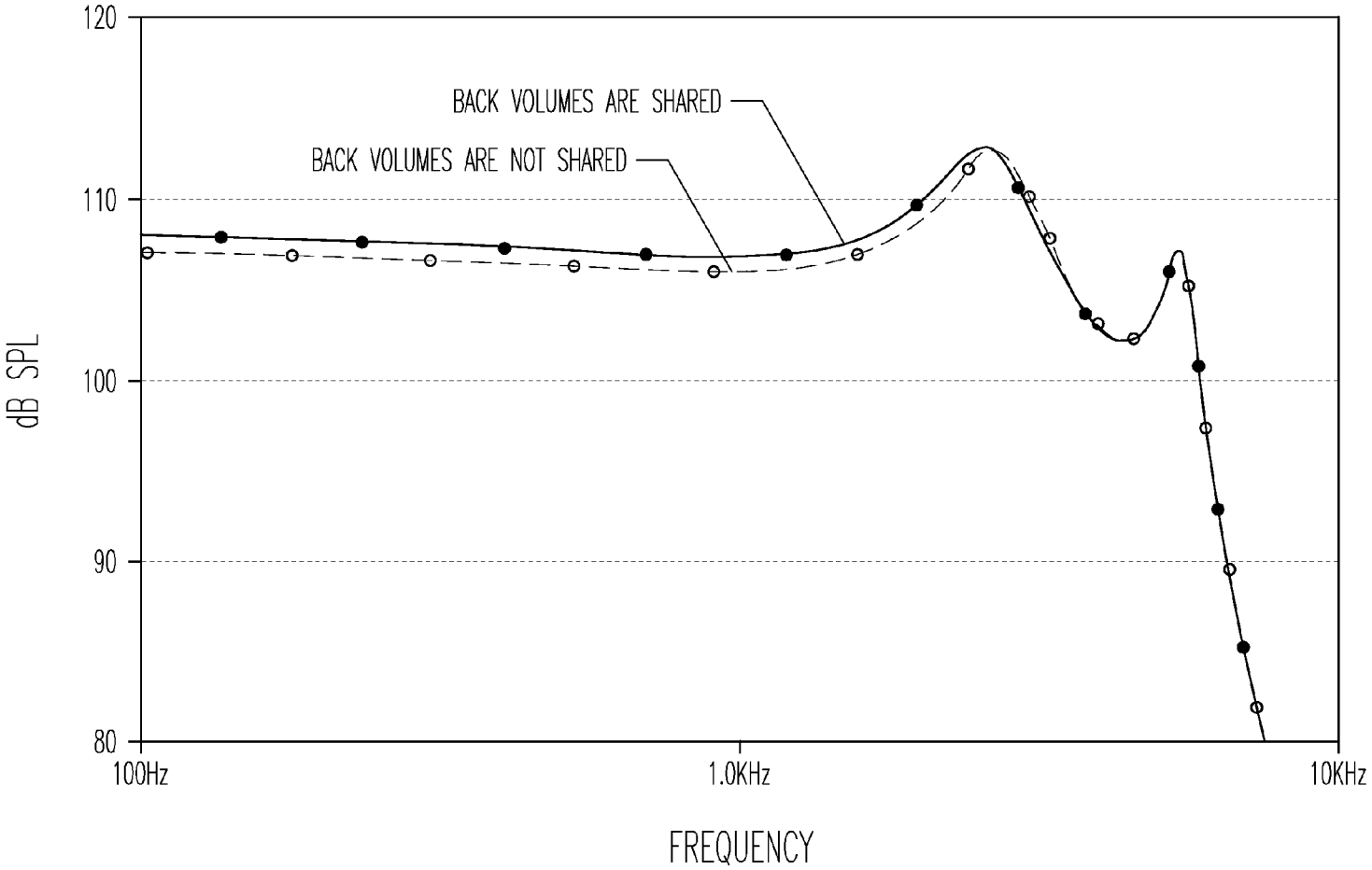

FIG. 9 show a simulation of the effect of reversing a small dual receiver outlets and sharing the back volumes as discussed above. The measurement results show higher outputs on low frequencies when the dual receiver outlets are reversed and the back volumes are shared.

Figure 10:
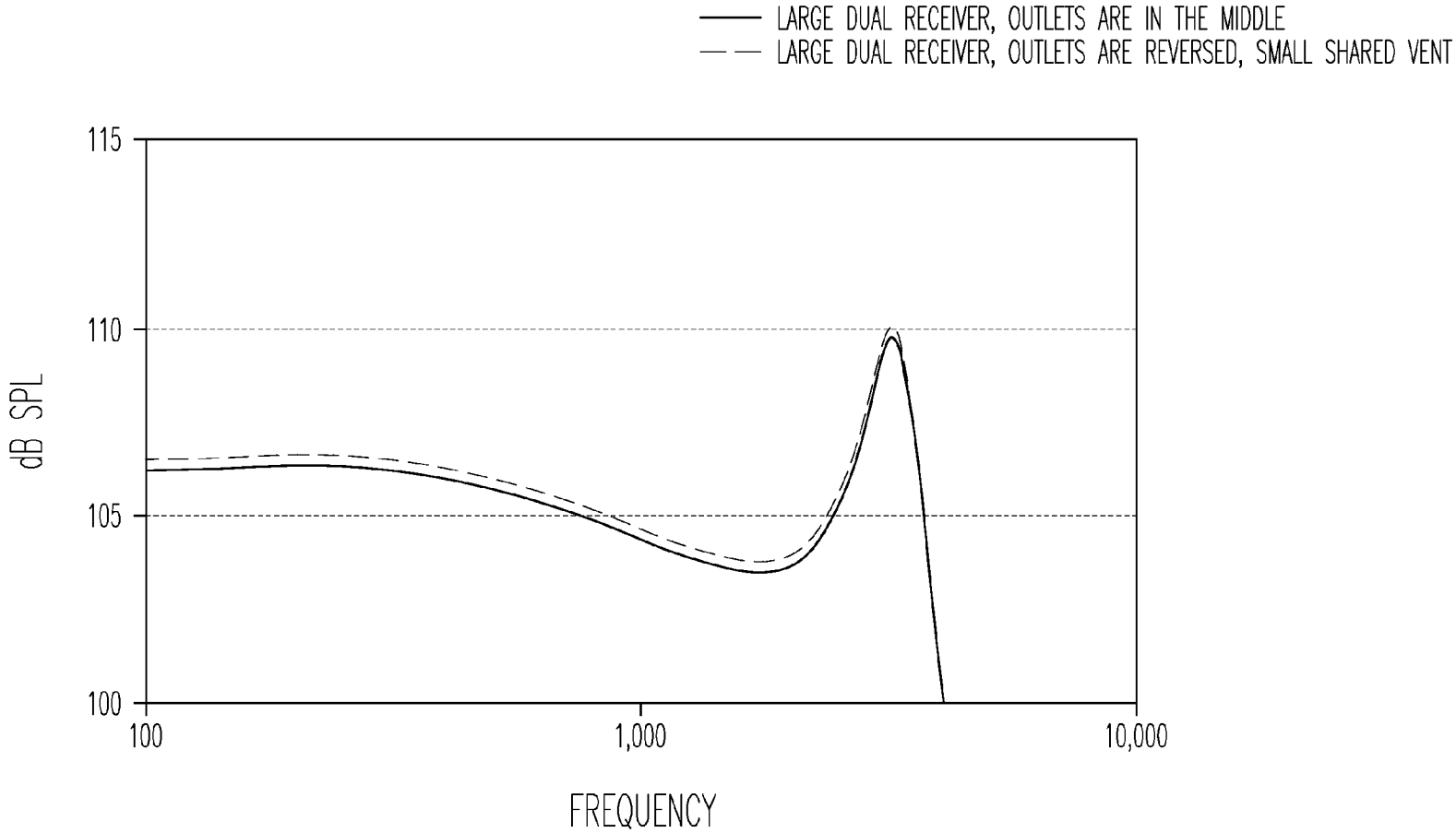

FIG. 10 show measurement results for the effect of reversing a large dual receiver outlets and sharing the back volumes with a small vent as discussed above. The measurement results show higher outputs on low frequencies when the dual receiver outlets are reversed and the back volumes are shared. The measurement result and the simulation described above indicate that this effect depends on the relative sizes of the additional air volume formed by a full or a partial removal of the receiver walls to the original back volumes.

The present subject matter provides for outlets of the low frequency receivers on the outside of the combined perimeter of the housing, and they can share their back volumes which provide a small robust package. The woofer is located back in the module so that the acoustical load causes frequency shift of the main peak therefore achieving better wideband frequency response, in various embodiments. The tweeter is put as close as possible to the spout to avoid high frequency attenuation and the wax guard design helps high frequency output, in various embodiments.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus for use with a hearing assistance device, comprising:

two low frequency spout-less receivers configured to act as a woofer; and a dual receiver attached to the front of the woofer, the receiver configured to act as a tweeter, wherein the acoustical load for each of the two low frequency receivers form a channel on each side of the tweeter, and wherein the apparatus is adapted to extend bandwidth of the hearing assistance device and to maintain low vibration of the dual receiver.

2. The apparatus of claim 1, wherein the low frequency receivers share one back volume to improve low frequency performance.

3. The apparatus of claim 1, wherein the tweeter includes a single receiver.

4. The apparatus of claim 1, wherein a total acoustical output of the dual receiver is divided into two acoustical flows by placing their outlets outside of a common perimeter of the dual receiver.

5. The apparatus of claim 1, wherein the woofer includes a dual receiver.

6. The apparatus of claim 1, further comprising:

a perforated angled tube connected to an outlet for the tweeter, the tube configured for wax protection and improved output of the apparatus.

7. The apparatus of claim 1, wherein the two low frequency spout-less receivers are the same type.

8. The apparatus of claim 1, wherein the two low frequency spout-less receivers are placed to combine their low frequency sounds in front of the tweeter.

9. The apparatus of claim 1, wherein the two low frequency spout-less receivers are placed without a front cavity.

10. The apparatus of claim 1, wherein an outlet of the tweeter is aligned behind a main outlet of the apparatus.

11. A receiver assembly, comprising:

a housing;

two low frequency spout-less receivers within the housing, the two low frequency receivers configured to act as a woofer;

a dual receiver within the housing and attached to the front of the woofer, the receiver configured to act as a tweeter; and a perforated angled tube connected to an outlet for the tweeter, the tube configured for wax protection and improved acoustical output of the assembly, wherein the acoustical load for each of the two low frequency receivers form a channel on each side of the tweeter, and wherein the receiver assembly is adapted to maintain low vibration of the dual receiver.

12. The receiver assembly of claim 11, wherein the tweeter includes a single receiver.

13. The receiver assembly of claim 11, wherein the tweeter, the housing and the tube form an angled sound guide configured for improved sound delivery.

14. The receiver assembly of claim 11, wherein the tweeter includes a spout.

15. The receiver assembly of claim 11, wherein the tweeter is spout-less.

16. The receiver assembly of claim 11, wherein the tweeter is arranged in a straight line with the woofer.

17. The receiver assembly of claim 11, wherein each of the two low frequency receivers is back vented into a back volume of the other low frequency receiver.

18. The receiver assembly of claim 11, wherein the two low frequency receivers share one back volume.

19. The receiver assembly of claim 11, wherein a front volume for the woofer is formed using the housing.

20. The receiver assembly of claim 11, wherein sides of the woofer form an angle with the tweeter to change the form factor of the assembly for better fit.

21. The receiver assembly of claim 11, wherein the woofer is vented in a space formed along sides of the tweeter.

22. A method of making a receiver assembly for a hearing assistance device, the method comprising:

providing two low frequency spout-less receivers configured to act as a woofer;

attaching a dual receiver to the front of the woofer, the receiver configured to act as a tweeter; and forming a channel on each side of the tweeter using the acoustical load for each of the two low frequency, wherein forming the channel includes extending bandwidth of the hearing assistance device and maintaining low vibration of the dual receiver.

23. The method of claim 22, further comprising connecting a perforated angled tube to an outlet for the tweeter, the tube configured for wax protection and improved high frequency output.

24. The method of claim 22, further comprising arranging the tweeter in line with the woofer.

25. The method of claim 22, wherein attaching a receiver to the front of the woofer includes attaching a spout-less receiver to the front of the woofer.

26. The method of claim 22, wherein the low frequency receivers share one back volume to improve low frequency performance.

* * * * *